United States Patent [19]

Howell

[11] Patent Number: 4,725,701

[45] Date of Patent: Feb. 16, 1988

[54] LOW VOLTAGE VACUUM CIRCUIT INTERRUPTER

[75] Inventor: Edward K. Howell, Simsbury, Conn.

[73] Assignee: General Electric Company, New York, N.Y.

[21] Appl. No.: 20,420

[22] Filed: Mar. 2, 1987

Related U.S. Application Data

[62] Division of Ser. No. 770,931, Aug. 30, 1985.

[51] Int. Cl.[4] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 2,284,644 | 6/1942 | Dubilier | 200/144 B |
| 3,731,026 | 5/1973 | Miles | 200/144 B |
| 4,109,122 | 8/1978 | Lipperts | 200/144 B |

*Primary Examiner*—Robert S. Macon
*Attorney, Agent, or Firm*—Richard A. Menelly; Walter C. Bernkopf; Fred Jacob

[57] ABSTRACT

A solid state switch connected across a pair of separable contacts for eliminating arcing across the contacts allows the contacts and the contact driver to be enclosed within an evacuated envelope. The vacuum environment allows the use of an inexpensive, highly conductive contact material, such as copper, without fear of chemical reaction.

8 Claims, 10 Drawing Figures

LOW VOLTAGE VACUUM CIRCUIT INTERRUPTER

This is a Divisional, of application Ser. No. 770,931, filed Aug. 30, 1985.

BACKGROUND OF THE INVENTION

The provision of a solid state switch across a pair of separable contacts to reduce arcing between the contacts, when separated, is disclosed within U.S. patent application Ser. No. 610,947 filed May 16, 1984 entitled "Solid State Current Limiting Interrupter" in the name of E. K. Howell. This application is incorporated herein for purposes of reference and should be reviewed for a good description of the circuit components used within the solid state switch.

The absence of an arc between the contacts, when separated, allows smaller contacts which in turn are more readily separated in the early stages of the current waveform to further reduce contact heating and deterioration. U.S. patent application Ser. No. 684,307 filed Dec. 20, 1984 entitled "High Speed Contact Driver For Circuit Interrupter Device" and U.S. patent application Ser. No. 759,710 filed Jul. 29, 1985 entitled "Piezoelectric Contact Driver For Circuit Interrupters", both in the name of E. K. Howell, disclose contact drivers for rapid circuit interruption by means of a pair of fixed contacts and a bridging contact operated by a contact driver. Both these applications are also incorporated herein for purposes of reference. The use of the solid state switch in combination with the high speed contact driver to separate the contacts allows the solid state circuit components to be reduced in rating and hence more economically feasible. U.S. patent application Ser. No. 763,574 filed Aug. 8, 1985 entitled "Change Of State Contact Material For Electric Circuit Interrupters", also in the name of E. K. Howell, describes a contact structure that allows for a reduction in the contact holding force which is required to provide low contact resistance between the contacts. This results in the use of smaller contacts and contact holding springs. This application is incorporated herein for purposes of reference and should be reviewed for a good understanding of the materials and arrangement used to promote these benefits.

By the synergistic combination of a solid state switch, high speed contact driver and change of state electrode materials, the size of the contacts and the means for separating the contacts can be reduced sufficiently to enable containment within an evacuated envelope. The use of the evacuated envelope now allows either the fixed contact pair or the bridging contact to be fabricated from copper metal rather than silver. The copper provides good electrical conduction between the contacts along with a substantial reduction in materials costs. The copper remains oxide-free under the vacuum contained within the sealed envelope as well as when reducing-type gases are employed instead of vacuum.

SUMMARY OF THE INVENTION

A low voltage vacuum interrupter consisting of a pair of fixed contacts and a bridging contact under the control of a high speed contact driver are arranged within an evacuated envelope. The fixed contacts comprise copper metal while the bridging contact comprises a change of state layered metal contact. A solid state switch connected across the fixed contact pair allows the contacts to be separated without the occurrence of any arc whatsoever.

DESCRIPTION OF THE PREFERRED EMBODIMENT

Figure 1:
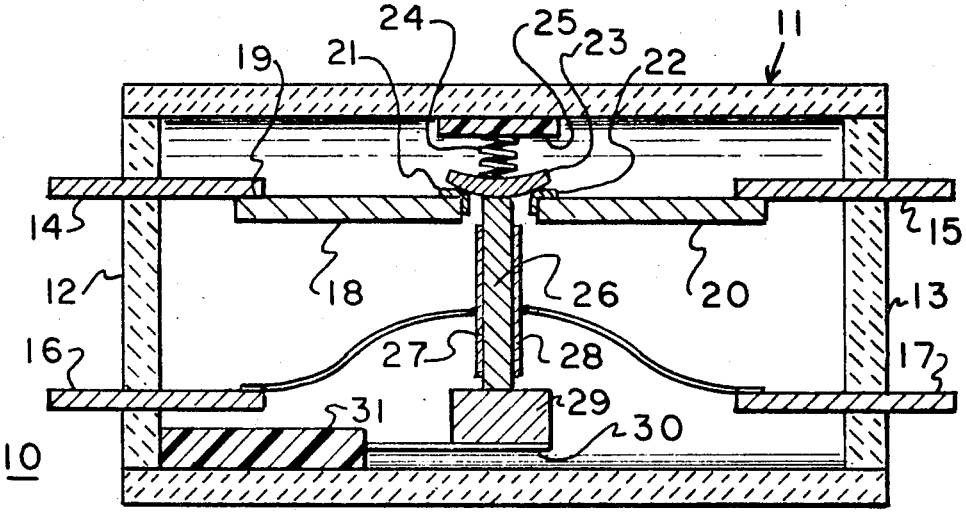
FIG. 1 is a side sectional view of a low voltage vacuum interrupter according to the invention.

A low voltage vacuum circuit interrupter 10 hereafter "vacuum interrupter" is depicted in FIG. 1 and consists of a hermetically sealed envelope 11 of a metal, glass or ceramic construction which is closed at the ends by means of endwalls 12 and 13. The housing is either cylindrical or rectangular in configuration and is evacuated to remove most of the air as is common with vacuum interrupters of the higher voltage type. For purposes of this disclosure, a low voltage vacuum interrupter is one used for interrupting circuit currents with circuit voltages less than 1000 volts. An example of a medium voltage vacuum interrupter is described in U.S. Pat. No. 3,014,110 in the name of James D. Cobine, which patent is incorporated herein for purposes of reference for its teachings of a state of the art medium voltage vacuum interrupter device. The low voltage vacuum interrupter 10 differs from the medium voltage vacuum interrupter by the provision of a pair of lead-in conductors 14, 15 for electrical connection with a pair of fixed contacts 21, 22 attached to the ends of a corresponding pair of shaped metal bars 18, 20 by means of a weld as indicated at 19. A bridging contact 23 is arranged across the fixed contact pair and is held in good electrical connection therewith by means of a contact spring 24 arranged on a support 25. To separate the bridging contact from the fixed contact pair, a piezoelectric bar 26 having a pair of electrodes 27, 28 on either side for attachment to lead-in wires 16, 17, is arranged for extension in its longitudinal direction transverse to the electrodes for striking the bridging contact and driving it out of electrical connection with the fixed contact pair. The piezoelectric bar is positioned between the bridging contact and a metal base 29 which in turn is supported on a cantilever spring 30. The cantilever spring is arranged on a support 31 which is fixedly attached to the envelope 11. The operation of the piezoelectric bar 26 is described within the aforementioned U.S. patent application entitled "Piezoelectric Contact Driver For Circuit Interrupters". When the fixed contact pair 21, 22 are electrically connected in parallel with a solid state switch, the circuit current transferring between lead-in wires 14, 15 across the contacts is first diverted through the solid state switch before a DC voltage pulse is applied across lead-in wires 16, 17 to drive the bridging contact away from electrical connection with the contact pair. Since most of the circuit current diverts through the solid state switch, only a small amount of current passes through the contacts at the instant of separation. This small amount of current is insufficient to establish an arc, particularly within the high vacuum environment maintained within the evacuated envelope 11. The high vacuum environment substantially reduces the possibility of reignition across the separated contacts when the solid state switch turns off and circuit voltage reoccurs across the fixed contact pair. An auxiliary switch (not shown) is usually connected in series with the fixed contact pair to completely interrupt the circuit path through the contacts after the solid state switch is turned off.

Figure 2:
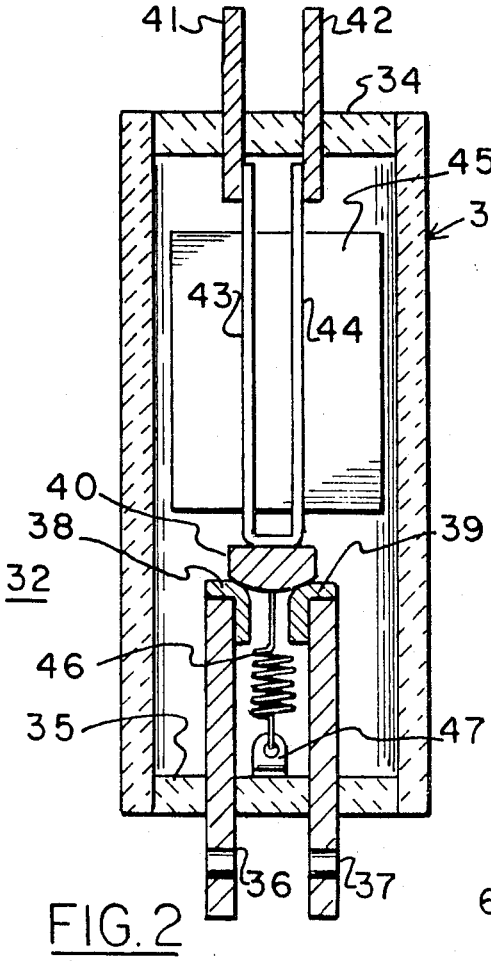
FIG. 2 is a side sectional view of an alternative low voltage vacuum interrupter according to the invention.

A low voltage vacuum interrupter 32 is shown in FIG. 2 contained within an evacuated envelope 33 which is similar to the envelope 11 depicted earlier in FIG. 1. The envelope 33 can be metal, ceramic or glass, depending mainly upon economic considerations. However, the endwalls 34, 35 should be ceramic or glass to ensure sufficient electric insulation between the lead wires 36, 37 which support the fixed contacts 38, 39 and between the lead-in wires 41, 42 which support the closely spaced wires 43, 44. The bridging electrode 40 is carried by the closely spaced wires for electrodynamic repulsion when a large current pulse is passed to the lead-in wires 41, 42. A plurality of magnetic plates 45 are arranged on either side of the closely spaced wires to enhance the electrodynamic repulsion. The bridging contact 40 is held in good electrical connection with the fixed contacts 38, 39 by means of the contact spring 46 which is attached to the envelope by means of an apertured support 47. The operation of the electrodynamic repulsion between the closely spaced wires 43, 44 is described within the aforementioned U.S. patent application entitled "High Speed Contact Driver For Circuit Interrupter Device".

Figure 3:
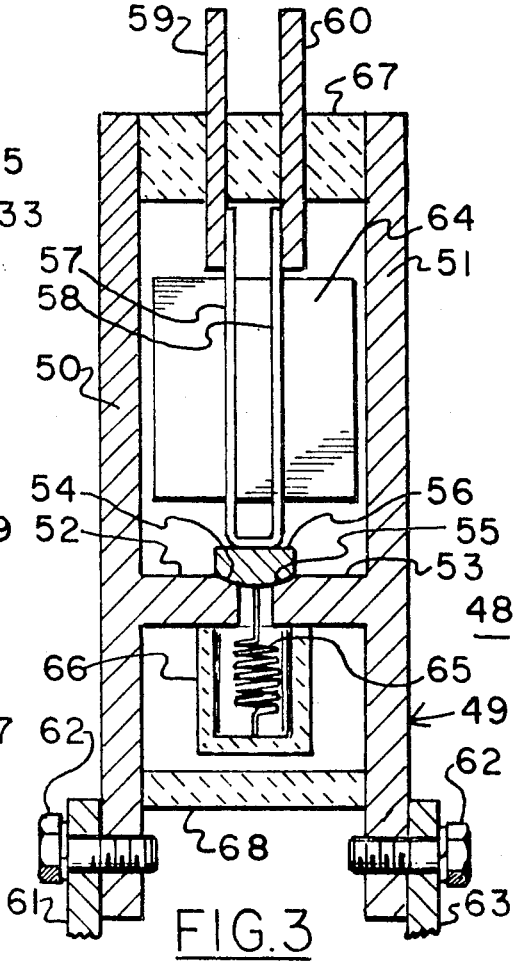
FIG. 3 is a side sectional view of a further embodiment of the low voltage vacuum interrupter according to the invention.

A further low voltage vacuum interrupter 48 is shown in FIG. 3 to consist of an H-shaped contact configuration 49 consisting of a stepped shaped metal bar 50 with a formed contact 54 arranged at one end of the step 52 integrally formed with the stepped shaped metal bar. A second stepped shaped metal bar 51 is arranged opposite the stepped shaped metal bar 50 such that the fixed contact 55 formed at one end of the step 53 is oppositely adjacent the contact 54. A bridging contact 56 is suspended from one end of a pair of closely spaced wires 57, 58 for electrodynamic repulsion when a current pulse is applied to the lead-in wires 59, 60. In a manner similar to the low voltage vacuum interrupter depicted in FIG. 2, a plurality of magnetic plates 64 are arranged on either side of the closely spaced wires to enhance the electrodynamic repulsion. A pair of ceramic endwalls 67, 68 are arranged at opposite ends of the H-shaped contact arrangement 49 to allow for electrical insulation between the lead wires 59, 60. Electrical connection is made with the contacts 54, 55 by means of a separate pair of wires 61, 63 attached to the stepped shaped metal bars 50, 51 by means of screws 62. The bridging contact is held in good electrical connection with contacts 54, 55 by means of a contact spring 65 attached to a U-shaped ceramic support 66. The low voltage vacuum interrupter 48 is hermetically sealed by the provision of a rectangular envelope (not shown) arranged on both sides of the H-shaped contact arrangement 49. The operation of the closely spaced wires 57, 58 to drive the bridging contact 67 out of electrical connection with the contacts 54, 55 is similar to that of the low voltage vacuum interrupter 32 depicted in FIG. 2. It is noted that the electrodes 54, 55 are formed from the same copper material used to fabricate the stepped shaped metal bars 50, 51. The evacuated environment within the low voltage vacuum interrupter allows the use of copper electrodes without fear of oxidation. A small amount of a reducing atmosphere, such as hydrogen gas, can be introduced to the envelope prior to evacuation to further ensure the absence of oxidation over long periods of continued use. The bridging contact 56 can have the components and configuration of the change of state contact material described within the aforementioned U.S. patent application entitled "Change Of State Contact Material For Electric Circuit Interrupters". This ensures good electrical conduction between the bridging contact 56 and the contacts 54, 55 with only a relatively small contact spring 65.

Figure 4:
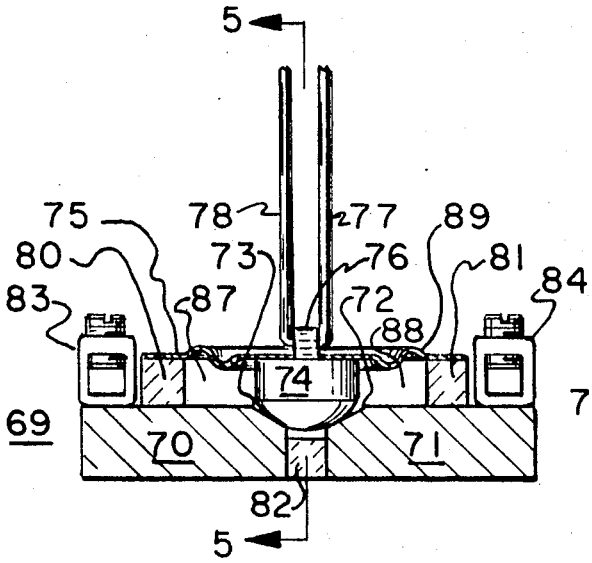
FIG. 4 is a side sectional view of an embodiment of the low voltage vacuum interrupter of the invention with an external contact driver.
Figure 5:
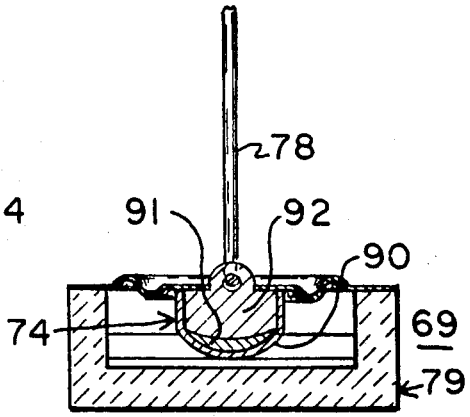
FIG. 5 is a cross sectional view of the low voltage vacuum interrupter depicted in FIG. 4.
Figure 6:
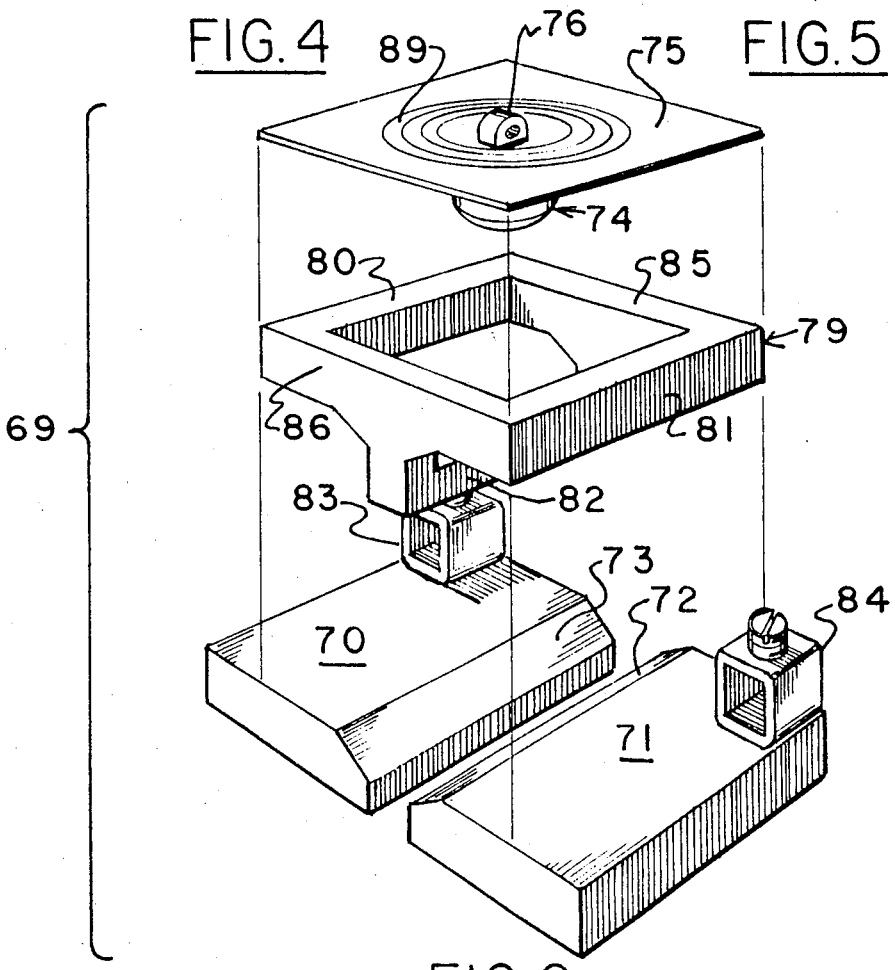
FIG. 6 is an exploded top perspective view of the vacuum circuit interrupter of FIG. 4 prior to assembly.

A low voltage vacuum interrupter 69 is depicted in FIGS. 4, 5 and 6 which does not utilize any contact spring whatsoever. The contacts 72, 73 are formed at one end of a pair of parallel spaced shaped metal bars 70, 71 and electrical connection is made therewith by means of terminal connectors 83, 84. A ceramic spacer 79 best seen in FIG. 6, is arranged such that one sidewall 81 is coextensive with shaped metal bar 71 and an opposite sidewall 80 is coextensive with shaped metal bar 70. A bottom extension 82 rests between the contacts 72, 73 to ensure the proper spacing and electrical insulation. A metal diaphragm 75 having an apertured boss 76 on an external surface thereof is hermetically sealed to the top of the ceramic spacer and the bridging contact 74 is attached to the interior side thereof. The diaphragm contains an expansion diameter 89 to promote the flexible movement of the diaphragm without interfering with the hermetic seal. The ceramic spacer 79 is also hermetically sealed to the shaped metal bars 70, 71 to define an evacuated space 87 on one side of the bridging contact and an evacuated space 88 on the opposite side. A pair of closely spaced wires 77, 78 are looped through the apertured boss 76 to provide a lifting force to the bridging contact in a manner similar to that described earlier for the low voltage vacuum interrupters depicted in FIGS. 2 and 3. Application of a high current pulse to the closely spaced wires 77, 78 allows the force exerted therebetween to pull or lift the apertured boss 76, diaphragm 75 and the bridging contact 74 without interfering with the security of the vacuum provided within the spaces 87, 88. The low voltage vacuum interrupter 69 is assembled in the manner best seen in FIG. 6 wherein the shaped metal bars 70, 71 which are formed from high purity copper, and with the lug connectors 83, 84 fixedly attached are arranged with the contacts 72, 73 oppositely adjacent each other and spaced apart to allow for the clearance of the botom extension 82 of the ceramic spacer 79. The spacer is arranged on the shaped metal bars such that the sidewalls 80, 81 seat directly on the shaped metal bars and the endwalls 85, 86 extend across and seat on both of the shaped metal bars. Once the ceramic spacer 79 is in place on the shaped metal bars, the metal diaphragm 75 with the bridging contact fixedly attached to a bottom surface and with the apertured boss 76 and raised diameter 89 is then placed on the ceramic spacer, coextensive with the sidewalls 80, 81 and the endwalls 85, 86. Prior to heating the assembled components to hermetically seal the diaphragm and shaped metal bars to the ceramic spacer, the assembly is placed in an evacuation chamber and a vacuum is applied until the interior spaces defined as 87, 88 in FIG. 4 reach a predetermined vacuum. The use of the evacuation chamber during the heating and fusing of the ceramic spacer ensures that the shaped metal bars 70, 71 remain free of any oxidation during the fusion process. The completely assembled low voltage vacuum interrupter 69 is depicted in FIG. 5 as viewed in the plane 4—4 which intersects the bridging contact 74 to show the outer nickel layer 90 intermediate indium layer 91 and silver base 92. When the low voltage vacuum interrupter is employed with a solid state switch to interrupt the circuit current, the bridging contact returns to bridge across the fixed contacts as soon as the current pulse is removed from the closely spaced wires 77, 78. This automatic return is caused by the atmospheric pressure acting on the flexible diaphragm 75. The difference in pressure on both sides of the diaphragm is equivalent to a force of approximately 16 lbs. per square inch of diaphragm area acting to force the attached bridging contact into good electrical connection with the fixed contacts without the requirement of any contact spring whatsoever. It is within the scope of this invention to use a gaseous material having enhanced dielectric properties, such as SF6, and to adjust the pressure of the gas with respect to the external atmosphere to obtain a wide range of force on the bridging contact to optimize the contact holding force and to obtain the optimum contact surface configuration of the change of state bridging contact to reduce heating effects to a minimum.

Figure 7:
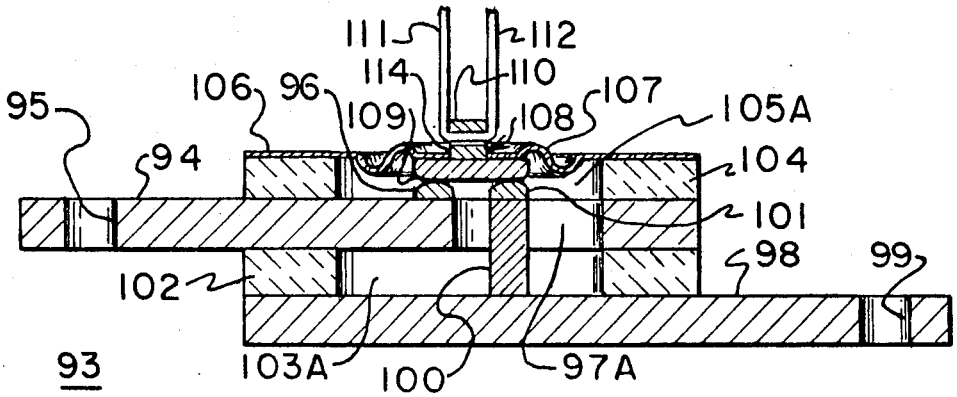
FIG. 7 is a side sectional view of a double break low voltage vacuum interrupter according to the invention.

A heavy duty double break vacuum interrupter 93 is shown in FIG. 7 and consists of a copper bar 94 having an aperture 95 for connection with an external electric terminal and a contact 96 fixedly attached, is arranged over a second copper bar 98 having an aperture 99 formed at one end for connection with the external electric circuit. The second copper bar has a copper post 100 extending perpendicular to the linear extent of the second copper bar and supports a contact 101 on a top surface thereof. A bridging contact 109 is formed on a contact rivet 108 which includes an apertured stem 110 passing through an apertured diaphragm 106. The contact rivet 108 is attached to the diaphragm 106 by means of a continous bead 114 of silver solder. A pair of closely spaced wires 111, 112 are arranged through the apertured stem 110 to provide the necessary force to lift the bridging contact 109 from the fixed contacts 96, 101 as previously described. A lower ceramic disc 102 is arranged on the second copper bar 98 to electrically insulate between the second copper bar and the first copper bar 94. An upper ceramic disc 104 is arranged between the first copper bar and the diaphragm 106 for electrical insulation therebetween. The diaphragm contains an expansion diameter 107 formed therein to provide for the movement of the bridging contact and the diaphragm without interfering with the integrity of the vacuum formed therein when the components are evacuated and sealed.

Figure 8:
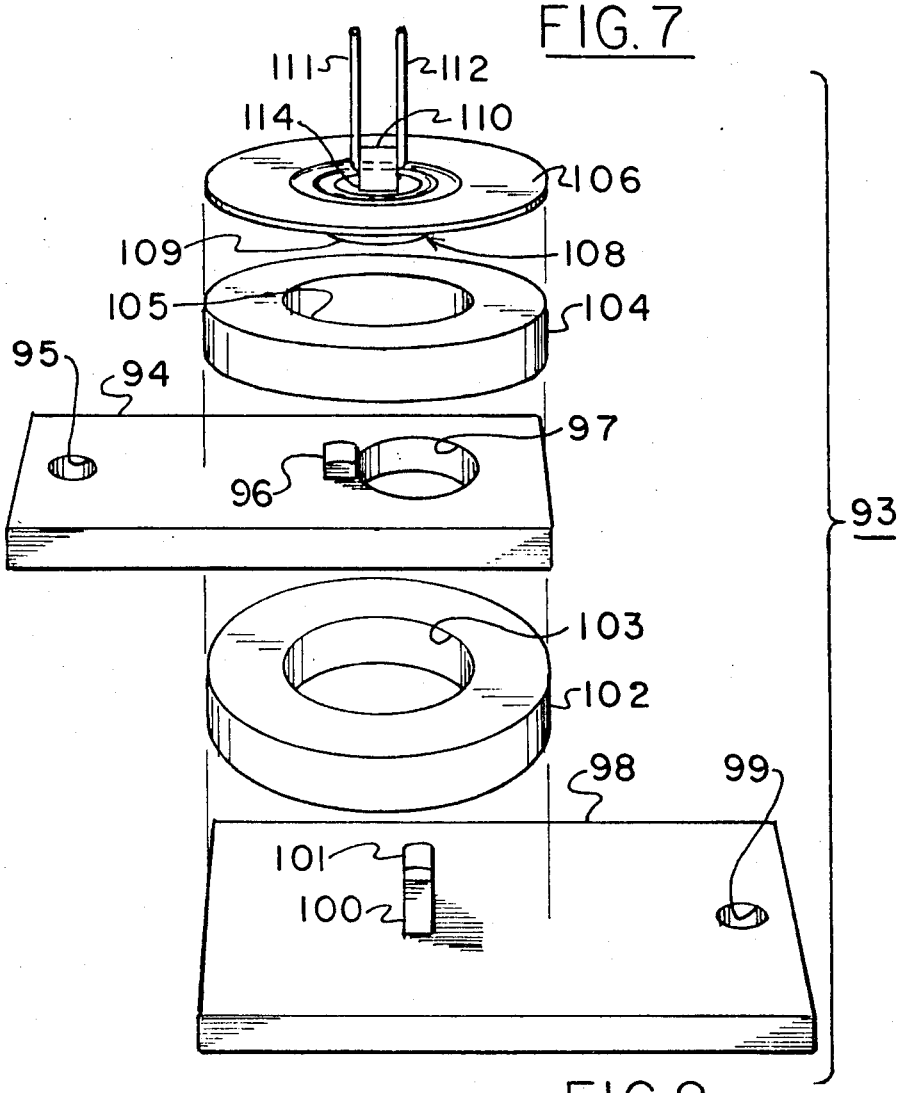
FIG. 8 is an exploded top perspective view of the low voltage vacuum interrupter of FIG. 7 prior to assembly.

The double break vacuum interrupter 93 of FIG. 7 is assembled in the manner best seen by referring now to FIG. 8. The second copper bar 98 is arranged with respect to the first copper bar 94 such that their respective apertures 99, 95 are opposite and their contacts 101, 96 extend in the same plane. The lower ceramic disc 102 is placed on the second copper bar such that the post 100 and contact 101 extend through the aperture 103. The aperture 97 formed within the first copper bar 94 is positioned such that the post 100 and contact 101 extend therethrough to allow the contacts 101, 96 to become co-planar. The upper ceramic disc 104 is placed over the first copper bar 94 such that both contacts extend through the aperture 105 formed within the upper ceramic disc. The diaphragm 106 with the bridging contact 109 on rivet 108 is positioned over the upper ceramic disc 104 such that the bridging contact extends through the aperture 105 to position the bridging contact across the fixed contacts 101, 96. The expansion diameter 107 is also arranged within the disc aperture 105 to provide for flex of the diaphragm 106 without interfering with the vacuum formed when the components are later hermetically sealed. The closely spaced wires 111, 112 arranged through the apertured stem are accessible from the exterior of the assembled vacuum interrupter 93 and the silver solder bead 114 extends around the apertured stem as previously described. When completely assembled, the lower disc aperture 103 defines a first space 103A, the first copper bar aperture 97 defines a second space 97A and the upper ceramic disc aperture 105 forms a third space 105A best seen by referring back to FIG. 7. The assembled components are then placed within an evacuation chamber and are heated and sealed such that the vacuum within the aformentioned spaces provides a requisite pressure differential to force the bridging contact 109 into excellent electrical contact with the fixed contacts 101, 96, without the requirement of a contact spring.

Figure 9:
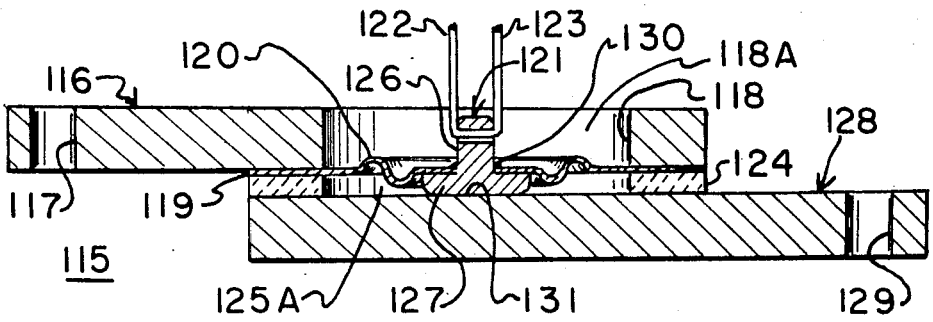
FIG. 9 is a side sectional view of a single break low voltage vacuum interrupter according to the invention.

A low power single break vacuum interrupter 115 is shown in FIG. 9 and consists of a first copper bar 116 having an aperture 117 for electrical connection with an external circuit and a second larger aperture 118 which defines a space 118A, as indicated. Within this space is arranged an apertured and flexible diaphragm 119 containing an expansion diameter 120 and through which a contact rivet 121 is inserted and fixedly attached by means of a bead 130 of silver solder. An apertured stem 126 supports a pair of closely spaced wires 122, 123 for moving the diaphragm and the single contact 127 in the manner described earlier. A single ceramic disc 124 is arranged between the first copper bar 116 and a second copper bar 128. The second copper bar contains an aperture 129 at one end for electrical connection with an external circuit. The single contact 127 mates with a surface of the second copper bar shown generally at 131 to provide an electrically conductive path from the second copper bar 128 through the single contact 127 and diaphragm 119 to the first copper bar 116. When a current pulse is applied to the closely spaced wires 122, 123 the force applied to the contact rivet 121 lifts the diaphragm and the single contact out of contact with the second copper bar 128 to interrupt the electrical connection between the first and second copper bars.

Figure 10:
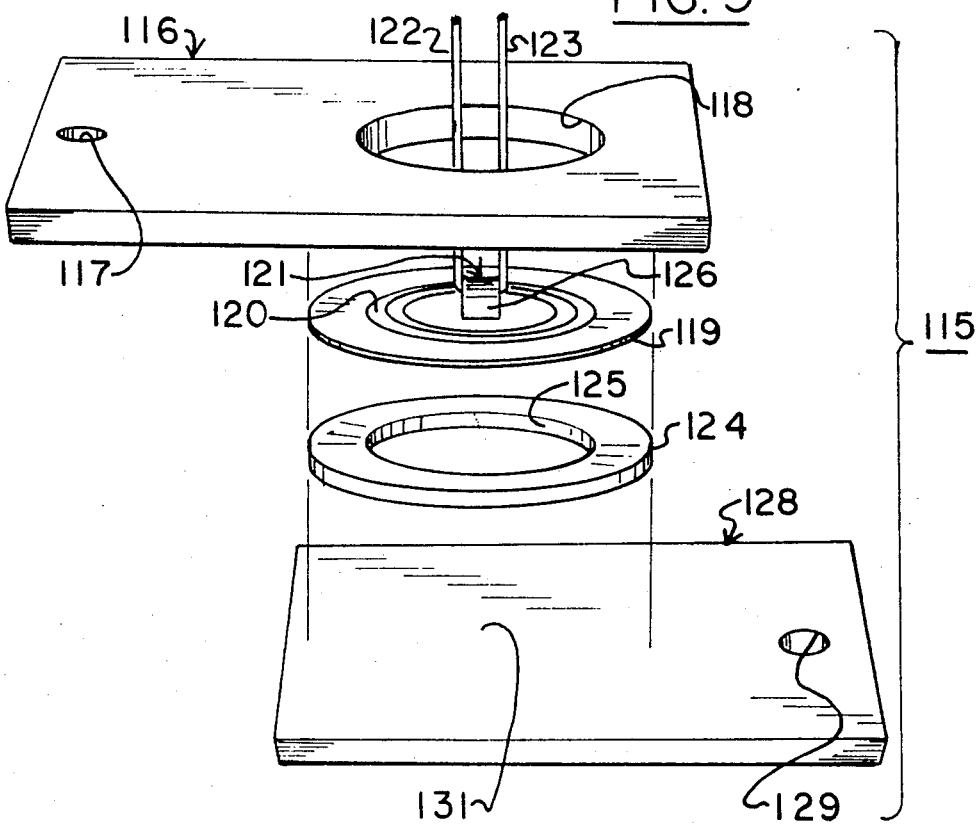
FIG. 10 is an exploded top perspective view of the low voltage interrupter of FIG. 9 prior to assembly.

The low power single break vacuum interrupter of FIG. 9 is assembled in the manner depicted in FIG. 10 and described as follows. The second copper bar 128 is arranged with the aperture 129 oriented opposite from the aperture 117 through the first copper bar 116. The ceramic disc 124 is then arranged on the second copper bar such that the aperture 125 surrounds the contact mating surface generally described at 131 and forms a space generally shown at 125A in FIG. 9. The flexible diaphragm 119 is placed on the ceramic disc with the expansion diameter 120 within the disc aperture and with the contact rivet 121 and apertured stem 126 concentrically arranged within the aperture 118 provided through the first copper bar and with the closely spaced wires 122, 123 extending through the aperture. When the components are assembled as depicted in FIG. 9, they are placed within an evacuation chamber and are evacuated and sealed in the manner described earlier. The low power single contacts vacuum interrupter 115 is useful in circuits wherein the current transport through the flexible diaphragm 119 is insufficient to cause excess heating of the diaphragm.

It is thus seen that the use of a solid state switch across a pair of contacts contained within an evacuated chamber allows the contacts to rapidly separate to interrupt circuit current with little or no deterioration due to arcing or chemical activity. The vacuum also allows the circuit to interrupt upon the occurrence of a very small separation distance because of the excellent dielectric properties inherent in the vacuum environment.

Having described my invention, what I claim as new and desire to secure by Letters Patent is:

1. A double break vacuum circuit interrupter comprising:

a first apertured metal bar having a first contact surface extending in a first plane at one end and means for connection with an external electric circuit proximate an opposite end;

a first dielectric disc seated on said first apertured metal bar encompassing said first contact surface and said first metal bar aperture;

a second metal bar having a second contact surface extending in said first plane at one end and means for connection with said electric circuit proximate an opposite end;

a second dielectric disc seated on said second metal bar and encompassing said second contact surface, said second contact surface extending through said first metal bar aperture coextensive with said first contact surface; and a flexible diaphragm seated on said first dielelectric disc and carrying a bridging contact on a bottom surface, said bridging contact abuting said first and second contact surfaces for interrupting current through said external current upon command.

2. The vacuum circuit interrupter of claim 1 including external means on a top surface of said flexible diaphragm for lifting said flexible diaphragm and moving said bridging contact out of abutment with said first and second contact surfaces to interrupt electrical connection between said first and second metal bars and said external electric circuit.

3. The vacuum circuit interrupter of claim 1 wherein said external means comprises a pair of spaced wires attached to said top surface of said flexible diaphragm at one end for becoming electrodynamically repulsed by application of an electric control signal to said spaced wires at an opposite end.

4. The vacuum circuit interrupter of claim 1 wherein said first metal bar, said first dielectric disc, said second metal bar, said second metal disc and said flexible diaphragm are sealed together to provide an enclosed space surrounding said first and second contact surfaces and said bridging contact.

5. The vacuum circuit interrupter of claim 4 wherein said enclosed space is partially evacuated.

6. The vacuum circuit interrupter of claim 4 wherein said enclosed space contains a non-oxidizing gas fill.

7. The vacuum circuit interrupter of claim 1 including a solid state switch connected across said first and second contact surfaces for transferring said circuit current away from said first and second contact surfaces prior to or during separation of said bridging contact from said first and contact cathode surfaces to interrupt said circuit current.

8. The vacuum circuit interrupter of claim 1 wherein said first and second metal bars comprise copper or aluminum.

* * * * *